US011122870B2

(12) United States Patent
Wachtmeister

(10) Patent No.: US 11,122,870 B2
(45) Date of Patent: Sep. 21, 2021

(54) JEWELRY FOR HOLDING AN INTERCHANGEABLE ORNAMENT

(71) Applicant: COURBET SAS, Paris (FR)

(72) Inventor: Marie-Ann Wachtmeister, Staffanstorp (SE)

(73) Assignee: COURBET SAS, Paris (FR)

( * ) Notice: Subject to any disclaimer, the term of this patent is extended or adjusted under 35 U.S.C. 154(b) by 35 days.

(21) Appl. No.: 16/622,199

(22) PCT Filed: Jun. 14, 2018

(86) PCT No.: PCT/EP2018/065832

§ 371 (c)(1),
(2) Date: Dec. 12, 2019

(87) PCT Pub. No.: WO2018/229203

PCT Pub. Date: Dec. 20, 2018

(65) Prior Publication Data

US 2020/0305562 A1 Oct. 1, 2020

(30) Foreign Application Priority Data

Jun. 14, 2017 (SE) ..... 1750756-7

(51) Int. Cl.
*A44C 17/02* (2006.01)

(52) U.S. Cl.
CPC ..... *A44C 17/0225* (2013.01)

(58) Field of Classification Search
CPC ..... A44C 17/0208; A44C 17/0216; A44C 17/0225; A44C 17/0258; A44C 17/0266
See application file for complete search history.

(56) References Cited

U.S. PATENT DOCUMENTS 394,928 A 12/1888 Kutner
1,263,539 A 4/1918 Edie
(Continued)

FOREIGN PATENT DOCUMENTS

CH 341345 11/1959
CN 201066441 Y 5/2008
(Continued)

OTHER PUBLICATIONS

International Search Report dated Sep. 5, 2018, issued in corresponding International Application No. PCT/EP2018/065832, filed Jun. 14, 2018, 3 pages.
(Continued)

*Primary Examiner* — Jack W Lavinder
(74) *Attorney, Agent, or Firm* — Christenson O'Connor Johnson Kindness PLLC

(57) ABSTRACT

The inventive concept relates to jewelry (200; 300) for holding an interchangeable ornament (210; 310), comprising a jewelry body (202; 302); a setting base (204; 304) arranged above and attached to the jewelry body (202; 302), the setting base (204; 304) having an upper and a lower surface; and a plurality of ornament holders (208; 308) arranged along a circumference of the setting base (204; 304) and extending in a vertical direction from the setting base (204; 304), at least one of which is a moveable ornament holder (208; 308). The at least one moveable ornament holder (208; 308) is configured to be moved between a first position in which the interchangeable ornament (210; 310) is restricted from moving, and a second position wherein the interchangeable ornament (210; 310) is moveable.

11 Claims, 2 Drawing Sheets

(56) References Cited

U.S. PATENT DOCUMENTS

| | | | | | |
|---|---|---|---|---|---|
| 1,971,265 | A | | 8/1934 | King | |
| 2,028,284 | A | | 1/1936 | Jackson | |
| 2,147,740 | A | | 2/1939 | Gruber | |
| 3,115,758 | A | * | 12/1963 | Eberle | A44C 9/00 63/15 |
| 5,133,195 | A | * | 7/1992 | Appelbaum | A44C 9/00 63/29.1 |
| 2006/0032270 | A1 | | 2/2006 | Doyno | |
| 2009/0193848 | A1 | | 8/2009 | Hsu | |
| 2013/0271964 | A1 | | 10/2013 | Rife | |
| 2017/0055646 | A1 | * | 3/2017 | Samanta | A44C 17/0225 |
| 2019/0223558 | A1 | * | 7/2019 | Machini | A44B 5/002 |

FOREIGN PATENT DOCUMENTS

| | | | | | |
|---|---|---|---|---|---|
| FR | 2715541 | A1 | * | 8/1995 | A44C 7/002 |
| GB | 427391 | | | 4/1935 | |

OTHER PUBLICATIONS

Search Report dated Nov. 30, 2017, issued in corresponding Swedish Application No. 1750756-7, filed Jun. 14, 2017, 3 pages.

* cited by examiner

JEWELRY FOR HOLDING AN INTERCHANGEABLE ORNAMENT

TECHNICAL FIELD

The present inventive concept relates to jewelry and particularly to rings for holding an interchangeable ornament which can be detached and remounted by the user.

BACKGROUND

A number of different gemstone settings of widely varying designs are known in the art. These settings are used to confine and fix precious stones or similar ornaments to a piece of jewelry, such as a finger ring, brooch, bracelet, necklace or tiara. The settings are made of more of less intricately shaped holding parts which typically require the substantial skill of a jeweler, making setting and replacing the stone or other ornament complicated, time consuming and expensive.

Traditionally the setting comprises a base with a number of prongs extending upwardly from the base, with the ends of the prongs being folded back over the stone or ornament to confine it and hold it securely in place. The number of prongs and their distribution depends on the size and shape of the stone.

Such ornament settings and similar commonly used settings typically require skill and specialized equipment to properly mount the ornament to the piece of jewelry. Hence, the detachment and replacement of gems and ornaments from such settings are difficult, rendering jewelry comprising such settings static in nature. Further, such ornament settings often require complex and bulky locking mechanisms.

There is a demand for jewelry settings which permit easy and secure detachment and exchange of stones or other ornaments on a piece of jewelry, primarily without any need for tools or special skills.

SUMMARY OF THE INVENTION

It is an object of the present inventive concept to mitigate, alleviate or eliminate one or more of the above-identified deficiencies in the art and disadvantages singly or in combination.

According to a first aspect of the inventive concept, these and other objects are achieved in full, or at least in part, by jewelry, such as a ring, for holding an interchangeable ornament, comprising a jewelry body, such as a ring body; a setting base arranged above and attached to the jewelry body, such as the ring body, the setting base having an upper and a lower surface; and a plurality of ornament holders arranged along a circumference of the setting base and extending in a vertical direction from the setting base, at least one of which is a moveable ornament holder, wherein the at least one moveable ornament holder is configured to be moved between a first position in which the interchangeable ornament is restricted from moving, and a second position wherein the interchangeable ornament is moveable.

The at least one moveable ornament holder may be pivotable around an axis.

The at least one moveable ornament holder may be pivotable around the axis by means of a shaft contained in the setting base, wherein the shaft is parallel to the upper and/or lower surface of the setting base.

The at least one moveable ornament holder may be pivotable around an axis being parallel to a tangent line in a point of the setting base where the at least one moveable ornament holder is arranged, wherein the axis is parallel to the upper and/or lower surface of the setting base.

The at least one moveable ornament holder may be pivotable around an axis being perpendicular to a tangent line in a point of the setting base where the at least one movable ornament holder is arranged, wherein the axis is parallel to the upper and/or lower surface of the setting base.

The at least one moveable ornament holder may be pivotable around the axis by means of a shaft contained in the setting base, wherein the shaft is perpendicular to the upper and/or lower surface of the setting base.

The at least one movable ornament holder may be pivotable around an axis being perpendicular to the upper and/or lower surface.

The at least one moveable ornament holder may be configured to be pivoted to such a degree that the interchangeable ornament is moveable along the upper surface of the setting base when the at least one moveable ornament holder is in the second position.

The at least one moveable ornament holder may comprise a plate arranged below the setting base, wherein the lower surface of the setting base comprises a recess configured to at least partially enclose the plate when the at least one moveable ornament holder is in the first position, and wherein the plate is configured to pivot around the axis when the at least one moveable ornament holder is moved between the first and second position.

The plate may be configured to restrict the at least one moveable ornament holder from being moved from the first position to the second position when the jewelry is used, i.e. worn by a user or wearer, such as a ring is worn on a finger, a watch or bracelet worn on an arm, a belt buckle on a belt around a waist, an anklet worn on an ankle, a brooch worn on clothing, an earring worn on an ear, or a necklace worn around the neck, e.g. choker.

The at least one moveable ornament holder may comprise a protrusion, and wherein the lower surface of the setting base comprises a groove corresponding to the protrusion, and wherein the protrusion is configured to engage with the groove when the at least one moveable ornament holder is in the first position in order to restrict the at least one moveable ornament holder from moving from the first position to the second position.

At least one of the plurality of ornament holders may comprise a portion being inclined towards the center of the setting base.

Other objectives, features and advantages of the present inventive concept will appear from the following detailed disclosure, from the attached claims as well as from the drawings.

Generally, all terms used in the claims are to be interpreted according to their ordinary meaning in the technical field, unless explicitly defined otherwise herein. All references to "a/an/the [element, device, component, means, step, etc]" are to be interpreted openly as referring to at least one instance of said element, device, component, means, step, etc., unless explicitly stated otherwise. The steps of any method disclosed herein do not have to be performed in the exact order disclosed, unless explicitly stated.

BRIEF DESCRIPTION OF THE DRAWINGS

The above, as well as additional objects, features and advantages of the present inventive concept, will be better understood through the following illustrative and non-limiting detailed description of different embodiments of the present inventive concept, with reference to the appended drawings, wherein.

DETAILED DESCRIPTION

The present disclosure describes jewelry for holding an interchangeable ornament. Initially, some terminology may be defined to provide clarification for the following disclosure.

The term "ornament" should be understood to mean any type of decorative element, such as stones, signets, pearls, and metal pieces, or any combination thereof.

Figure 1:
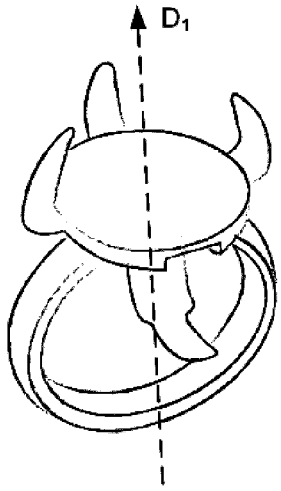
FIG. 1 schematically illustrates an example of a ring for holding an interchangeable ornament.

The term "vertical direction" refers to a direction $D_1$ as indicated in FIG. 1.

The term "horizontal direction" refers to a direction contained in a plane perpendicular to the vertical direction.

The jewelry may be a ring, a watch, a bracelet, a brooch, a belt buckle, an anklet, a necklace. Although the following disclosure may be made with reference to a ring, it is to be understood that the inventive concept may be applicable to other types of jewelry as disclosed above.

The jewelry may be made of any material suitable for jewelry, preferably metal. In particular, the jewelry may be made of a soft metal, such as gold or silver. The jewelry comprises a jewelry body, e.g. a ring comprises a ring body, a watch comprises a watch body, a bracelet comprises a bracelet body, a belt buckle comprises a belt body, an anklet comprises an anklet body, a brooch comprises a brooch body, an earring comprises an earring body, and a necklace comprises a necklace body. The jewelry body, such as a ring body, may be substantially annular. The jewelry body may define an inner area through which a part of the body or the wearer is intended to pass when the jewelry is worn on a body part, a finger is intended to pass when the ring is worn on a finger. For example, for a ring, the ring body may define an inner area through which a finger is intended to pass when the ring is worn on a finger.

The jewelry further comprises a setting base arranged above and attached to the jewelry body. The term "above" should in this context be understood to mean above in a vertical direction $D_1$ as indicated in FIG. 1. The jewelry may comprise more than one setting base. However, the following disclosures are made with reference to a single setting base. The setting base may be integral to the jewelry body. The setting base has an upper and a lower surface. The setting base may extend in a plane perpendicular to the vertical direction. In other words, the setting base may have a flat upper surface. However, it is to be understood that the setting base is not restricted to a flat upper surface, but in contrast may have a curved upper surface, e.g. a half-pipe shape, in order to hold ornaments such as pearls or the like. The upper surface of the setting base may be shaped, as seen in a vertical direction $D_1$, to conform to the interchangeable ornament intended to be placed on the setting base. The upper surface of the setting base may be shaped, as seen in the vertical direction $D_1$, to represent a surface of the interchangeable ornament intended to abut the upper surface of the setting base. However, it is to be understood that the shape of the upper surface, as seen in the vertical direction $D_1$, may be smaller or larger than the surface of the interchangeable ornament intended to abut the upper surface of the setting base. In other words, the shape of the upper surface, as seen in the vertical direction $D_1$, may be similar to the surface of the interchangeable ornament intended to abut the upper surface of the setting base.

The jewelry further comprises a plurality of ornament holders arranged along a circumference of the setting base and extending in a vertical direction $D_1$ from the setting base. The plurality of ornament holders arranged may extend substantially in a vertical direction $D_1$ from the setting base. At least one of the plurality of ornament holders may comprise a portion being inclined towards the center of the setting base. Thus, the interchangeable ornament may be restricted from moving in a horizontal direction and/or in the vertical direction $D_1$ by the at least one of the plurality of ornament holders. The jewelry may comprise at least two ornament holders, such as three ornament holders, such as four ornament holders. The plurality of ornament holders may be arranged symmetrically along the circumference of the setting base. However, it is to be understood that it is possible to arrange the plurality of ornament holders asymmetrically along the circumference of the setting base.

At least one of the plurality of ornament holders is a moveable ornament holder. The at least one movable ornament holder is configured to be moved between a first position in which the interchangeable ornament is restricted from moving, and a second position wherein the interchangeable ornament is moveable. In the first position, the interchangeable ornament may be restricted from moving by the setting base and the plurality of ornament holders. In the second position, the interchangeable ornament may be movable in a substantially horizontal direction. In other words, when the at least one of the plurality of ornament holders is in the second position, the interchangeable ornament may be allowed to move in a substantially horizontal direction such that the interchangeable ornament can be removed from the setting base. It is to be understood that the interchangeable ornament holder may initially be moved along the substantially horizontal direction a sufficient distance such that the interchangeable ornament may subsequently be removed from the setting base in a direction comprising a vector in the vertical direction $D_1$.

The setting base may comprise a biasing element configured to apply a bias to the at least one moveable ornament holder such that the same is forced towards the first position. Hereby, the at least one moveable ornament holder may be kept in the first position unless a force overcoming a bias force corresponding to the bias is applied. The biasing element may be a spring coil.

The at least one moveable holder may be pivotable around an axis. In the second position, the at least one moveable ornament holder may be pivoted relative the first position. The at least one moveable ornament holder may be pivotable around an axis by means of a shaft contained in the setting base. The shaft may be parallel to the upper and/or lower surface of the setting base. In other words, the shaft may be parallel to the horizontal direction. The shaft may be parallel to the vertical direction $D_1$. The shaft may be arranged at the circumference of the setting base.

In one embodiment, the at least one moveable ornament holder may be pivotable in a pivoting plane intersecting a center point of the setting base and a center point of the at least one moveable ornament holder, wherein the plane is perpendicular to the horizontal direction. In other words, the at least one moveable ornament holder may be pivotable around an axis being parallel to a tangent line in a point of the setting base where the at least one moveable ornament holder is arranged. Thus, the shaft may be parallel to a tangent line in a point of the setting base where the at least one moveable ornament holder is arranged. In yet other words, the shaft may be perpendicular to the pivoting line extending from the center point of the setting base to the center point of the at least one moveable ornament holder.

In one embodiment, the at least one moveable ornament holder may be pivotable in a pivoting plane perpendicular to a line extending from a center point of the setting base to a center point of the at least one moveable ornament holder, wherein the plane is perpendicular to the horizontal direction. In other words, the at least one moveable ornament holder may be pivotable around an axis being perpendicular to a tangent line in a point of the setting base where the at least one movable ornament holder is arranged. Thus, the shaft may be perpendicular to a tangent line in a point of the setting base where the at least one moveable ornament holder is arranged. In yet other words, the shaft may be parallel to the line extending from the center point of the setting base to the center point of the at least one moveable ornament holder. In this arrangement, the jewelry preferably comprises three or four ornament holders. The three ornament holders may be symmetrically arranged around the circumference of the setting base. In contrast, the four ornament holders are preferably arranged asymmetrically around the circumference of the setting base. In particular, the at least one moveable ornament holder is preferably arranged such that an arc distance along the circumference between the at least one moveable ornament holder and another of the plurality of ornament holders towards which the at least one moveable ornament holder is pivotable is greater than a corresponding arc distance along the circumference between two of the plurality of ornament holders which are not moveable.

The at least one moveable ornament holder may be configured to be pivoted to such a degree that the interchangeable ornament is moveable along the upper surface of the setting base when the at least one moveable ornament holder is in the second position. The at least one moveable ornament holder may be configured to be pivoted at least 90 degrees relative the first a second positions. In other words, the angular distance between the first and second position may be at least 90 degrees.

In one embodiment, the at least one moveable ornament holder may be pivotable in a pivoting plane perpendicular to the vertical direction $D_1$. In other words, the at least one moveable ornament holder may be pivotable around an axis being parallel to the vertical direction $D_1$. Thus, the shaft may be parallel to the vertical direction $D_1$. The shaft may be arranged substantially in the center of the setting base.

The lower surface of the setting base may comprise a recess arranged to at least partially enclose a portion of the at least one moveable ornament holder. The recess may provide for that the at least one moveable ornament holder is pivotable around an axis.

In one embodiment, the at least one moveable ornament holder may be configured to slide along the circumference of the setting base. The at least one moveable ornament holder may be configured to be inserted into sliding groove in the upper and/or lower surface of the setting base. The sliding groove may extend a distance along the circumference of the setting base, such that the at least one moveable ornament holder is able to slide at least the distance along the circumference of the setting base.

The at least one moveable ornament holder may comprise a plate arranged in line with the lower surface of the setting base and/or below the setting base. The term "below" should in this context be understood to mean below in a vertical direction $D_1$ as indicated in FIG. 1. The lower surface of the setting base may comprise a recess. The recess may correspond to the plate. In other words, the shape of the recess may correspond to the shape of the plate. The recess may be configured to at least partially enclose the plate when the at least one moveable ornament holder is in the first position. The plate may be configured to pivot around the axis when the at least one moveable ornament holder is moved between the first and second position. The plate may extend across substantially a full length of the lower surface of the setting base. The recess may extend across substantially a full length of the lower surface of the setting base.

The plate may be configured to restrict the at least one moveable ornament holder from being moved from the first position to the second position when the jewelry is worn on a body part, such as a ring is worn on a finger. Thus, the plate may decrease the risk of the at least one moveable ornament holder being accidentally moved from the first position to the second position when the jewelry is worn on a body part, such as a ring is worn on a finger. This function may be provided for by configuring the plate to be pivoted around the axis along with the pivoting movement of the at least one moveable ornament holder. In the second position of the at least one ornament holder, the plate may be configured to extend below the lower surface of the setting base. In other words, the plate may be configured to, when the at least one ornament holder is in the second position, extend into a volume defined by moving the inner area of the jewelry body, such as ring body, along the horizontal direction perpendicular to the inner area. Thus, when the jewelry is worn on a body part, such as a ring is worn on a finger, and the finger is thereby occupying the volume defined by moving the inner area of the jewelry body, such as ring body, along the horizontal direction perpendicular to the inner area, the plate is restricted from pivoting, and the at least one moveable ornament holder is restricted from moving from the first position to the second position.

The at least one moveable ornament holder may comprise a protrusion. It is to be understood that the protrusion may be a notch or a pin. The protrusion may be arranged on the plate of the at least one moveable ornament holder. The lower surface of the setting base may comprise a groove corresponding to the protrusion. The protrusion may be configured to engage with the groove when the at least one moveable ornament holder is in the first position in order to restrict the at least one moveable ornament holder from moving from the first position to the second position. The groove may be configured to be slightly too narrow and/or too small for the protrusion, such that, when the at least one movable ornament holder is in the first position, the protrusion is held in place by the groove. In other words, the protrusion may be configured to abut at least one surface of the groove, thus increasing the resistance which has to be overcome in order to move the at least one movable ornament holder from the first position to the second position. The protrusion and/or groove may be configured to give tactile and/or audible feedback to a user when the at least one moveable ornament holder is moved into the first position. The tactile feedback may be provided by, for example, configuring the groove to be slightly too narrow and/or too small for the protrusion. The protrusion may thus abut at least one surface of the groove, giving rise to a frictional force, when the at least one moveable ornament holder is moved into the first position. Thus, the user has to overcome a counter-acting force, in this case the frictional force, in order to move the at least one ornament holder into the first position. When the user eventually overcomes the counter-acting force, the plate may snap into place in the recess of the lower surface of the setting base, giving rise to a tactile feedback and/or a snapping sound, indicating to the user that the at least one movable ornament holder is in the first position, and that the interchangeable ornament is secured.

FIG. 1 illustrates an example of a ring for holding an interchangeable ornament according to the inventive concept. The ring comprises a ring body; a setting base arranged above and attached to the ring body, the setting base having an upper and a lower surface; and a plurality of ornament holders arranged along a circumference of the setting base and extending in a vertical direction from the setting base, at least one of which is a moveable ornament holder, wherein the at least one moveable ornament holder is configured to be moved between a first position in which the interchangeable ornament is restricted from moving, and a second position wherein the interchangeable ornament is moveable. For the sake of clarity, the vertical direction $D_1$ is illustrated in the example.

Figure 2:
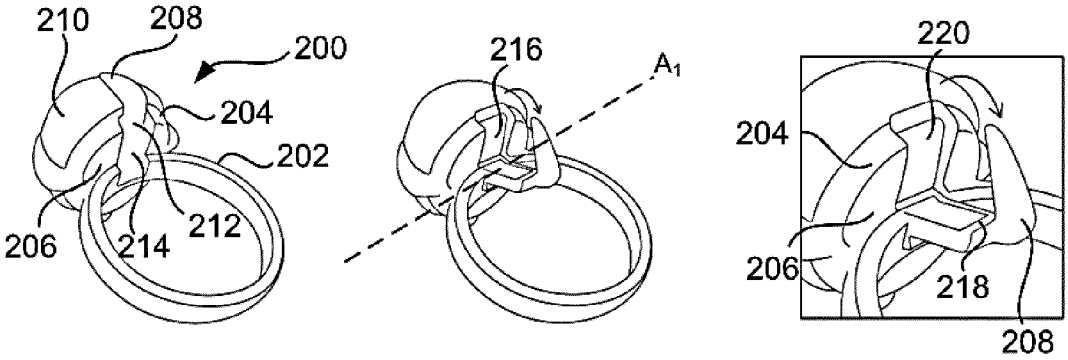
FIG. 2 schematically illustrates a perspective view of an example of a ring for holding an interchangeable ornament.

Referring now to FIG. 2, an example of a ring 200 for holding an interchangeable ornament 210 is illustrated in a set of three illustrations. The ring 200 comprises a ring body 202; a setting base 204 arranged above and attached to the ring body 202, the setting base 204 having an upper and a lower 206 surface; and a plurality of ornament holders arranged along a circumference of the setting base 204 and extending in a vertical direction from the setting base 204, at least one of which is a moveable ornament holder 208, wherein the at least one moveable ornament holder 208 is configured to be moved between a first position in which the interchangeable ornament 210 is restricted from moving, and a second position wherein the interchangeable ornament 210 is moveable. The leftmost illustration of the set of illustrations visualizes an example of the first position of the at least one moveable ornament holder 208. Similarly, the center illustration of the set of illustrations visualizes an example of the second position of the at least one moveable ornament holder 208.

The moveable ornament holder 208 is pivotable around an axis $A_1$. In the illustrated example, a shaft contained in the setting base 204 provides for that the moveable ornament holder 208 is pivotable around the axis $A_1$. The shaft is parallel to the upper surface of the setting base 208. Further the axis $A_1$ is parallel to a tangent line in a point 212 of the setting base where the moveable ornament holder 208 is arranged. Hereby, the moveable ornament holder 208 can be pivoted outwards from the setting base 204 such that the interchangeable ornament 210 can be moved along the upper surface and be reversibly removed from the ring 200.

The moveable ornament holder 208 comprises a plate 214 arranged below the setting base 204. The lower surface of the setting base 204 comprises a recess 216 configured to at least partially enclose the plate 214 when the moveable ornament holder 208 is in the first position. The plate 214 is configured to pivot around the axis $A_1$ when the moveable ornament holder 208 is moved between the first and second position. The plate 214 is configured to restrict the moveable ornament holder 208 from being moved from the first position to the second position when the ring is worn on a finger.

The moveable ornament holder 208 comprises a protrusion 218, and the lower surface of the setting base comprises a groove 220 corresponding to the protrusion 218. The protrusion 218 is configured to engage with the groove 220 when the moveable ornament holder 208 is in the first position in order to restrict the moveable ornament holder 208 from moving from the first position to the second position.

Figure 3:
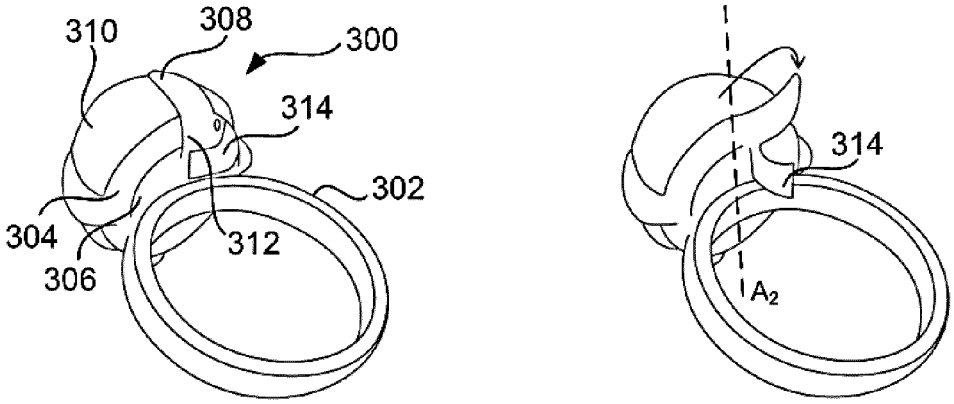
FIG. 3 schematically illustrates a perspective view of an example of a ring for holding an interchangeable ornament.

Referring now to FIG. 3, an example of a ring 300 for holding an interchangeable ornament 310 is illustrated. The ring 300 comprises a ring body 302; a setting base 304 arranged above and attached to the ring body 302, the setting base 304 having an upper and a lower 306 surface; and a plurality of ornament holders arranged along a circumference of the setting base 304 and extending in a vertical direction from the setting base 304, at least one of which is a moveable ornament holder 308, wherein the at least one moveable ornament holder 308 is configured to be moved between a first position in which the interchangeable ornament 310 is restricted from moving, and a second position wherein the interchangeable ornament 310 is moveable.

The moveable ornament holder 308 is pivotable around an axis $A_2$. In the illustrated example, a shaft contained in the setting base 304 provides for that the moveable ornament holder 308 is pivotable around the axis $A_2$. The shaft is parallel to the upper surface of the setting base 304. Further, the axis $A_2$ is perpendicular to a tangent line in a point 312 of the setting base 304 where the moveable ornament holder 308 is arranged. Hereby, the moveable ornament holder 308 can be pivoted outwards from the setting base 304 such that the interchangeable ornament 310 can be moved along the upper surface and be reversibly removed from the ring 300.

The moveable ornament holder 308 comprises a plate 314 arranged below the setting base 304. The lower surface of the setting base 304 comprises a recess (not shown) configured to at least partially enclose the plate 314 when the moveable ornament holder 308 is in the first position. The plate 314 is configured to pivot around the axis $A_1$ when the moveable ornament holder 308 is moved between the first and second position. The plate 314 is configured to restrict the moveable ornament holder 308 from being moved from the first position to the second position when the ring is worn on a finger.

The moveable ornament holder 308 comprises a protrusion (not shown), and the lower surface of the setting base comprises a groove (not shown) corresponding to the protrusion. The protrusion is configured to engage with the groove when the moveable ornament holder 308 is in the first position in order to restrict the moveable ornament holder 308 from moving from the first position to the second position.

Figure 4:
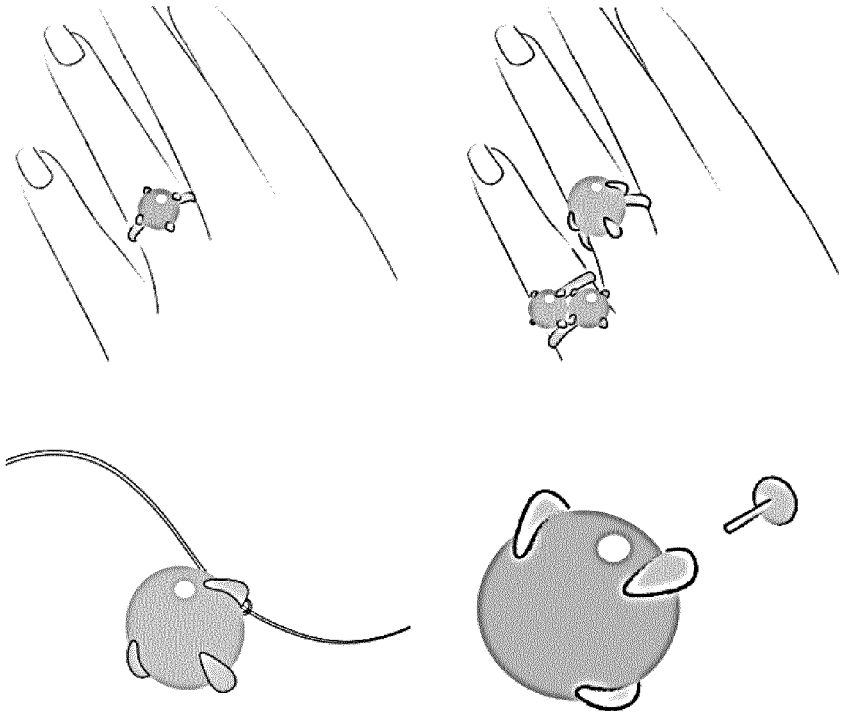
FIG. 4 illustrates various examples and applications of jewelry for holding interchangeable ornaments.

Referring now to FIG. 4, various examples and applications of jewelry for holding an interchangeable ornament are illustrated. For example, the jewelry may comprise two setting bases in order to hold two interchangeable ornaments. Further, the setting base may be attached to a link in order to form a necklace. Further, the setting base may be configured to connect to a locking pin in order to create an earring, such as an ear pendant or earclip.

In one embodiment, at least one of the plurality of ornament holders is movable in a tangential direction of the setting base (or of the interchangeable ornament when positioned in the setting base) between a first position and a second position. In other words, the at least one moveable ornament holder is movable along a portion of the outer circumference of the setting base (or of the interchangeable ornament when positioned in the setting base) between the first position and the second position. In the first position, the interchangeable ornament is restricted from moving, and, in the second position, the interchangeable ornament is moveable.

The inventive concept has mainly been described above with reference to a few embodiments. However, as is readily appreciated by a person skilled in the art, other embodiments than the ones disclosed above are equally possible within the scope of the inventive concept, as defined by the appended patent claims.

The invention claimed is:

1. Jewelry for holding an interchangeable ornament, comprising a jewelry body;

a setting base arranged above and attached to said jewelry body, said setting base having an upper and a lower surface; and a plurality of ornament holders arranged along a circumference of said setting base and extending in a vertical direction from said setting base, at least one of which is a moveable ornament holder, wherein said at least one moveable ornament holder is configured to be moved between a first position in which said interchangeable ornament is restricted from moving, and a second position wherein said interchangeable ornament is moveable, wherein said at least one moveable ornament holder comprises a protrusion, and wherein said lower surface of said setting base comprises a groove corresponding to said protrusion, and wherein said protrusion is configured to engage with said groove when the at least one moveable ornament holder is in the first position in order to restrict said at least one moveable ornament holder from moving from said first position to said second position.

2. The jewelry according to claim 1, wherein said at least one moveable ornament holder is pivotable around an axis.

3. The jewelry according to claim 2, wherein said at least one moveable ornament holder is pivotable around said axis by means of a shaft contained in said setting base, wherein said shaft is parallel to said upper and/or lower surface of said setting base.

4. The jewelry according to claim 2, wherein said at least one moveable ornament holder is pivotable around an axis being parallel to a tangent line in a point of said setting base where said at least one moveable ornament holder is arranged, wherein said axis is parallel to said upper and/or lower surface of said setting base.

5. The jewelry according to claim 2, wherein said at least one moveable ornament holder is pivotable around an axis being perpendicular to a tangent line in a point of said setting base where said at least one movable ornament holder is arranged, wherein said axis is parallel to said upper and/or lower surface of said setting base.

6. The jewelry according to claim 2, wherein said at least one moveable ornament holder is pivotable around said axis by means of a shaft contained in said setting base, wherein said shaft is perpendicular to said upper and/or lower surface of said setting base.

7. The jewelry-according to claim 6, wherein said at least one movable ornament holder is pivotable around an axis being perpendicular to said upper and/or lower surface.

8. The jewelry according to claim 2, wherein said at least one moveable ornament holder is configured to be pivoted to such a degree that said interchangeable ornament is moveable along said upper surface of said setting base when said at least one moveable ornament holder is in said second position.

9. The jewelry according to claim 1, wherein at least one of said plurality of ornament holders comprises a portion being inclined towards the center of said setting base.

10. Jewelry for holding an interchangeable ornament, comprising:

a jewelry body;

a setting base arranged above and attached to said jewelry body, said setting base having an upper and a lower surface; and a plurality of ornament holders arranged along a circumference of said setting base and extending in a vertical direction from said setting base, at least one of which is a moveable ornament holder, wherein said at least one moveable ornament holder is configured to be moved between a first position in which said interchangeable ornament is restricted from moving, and a second position wherein said interchangeable ornament is moveable, wherein said at least one moveable ornament holder is pivotable around an axis, and wherein said at least one moveable ornament holder comprises a plate arranged below said setting base, wherein said lower surface of said setting base comprises a recess configured to at least partially enclose said plate when said at least one moveable ornament holder is in said first position, and wherein said plate is configured to pivot around said axis when said at least one moveable ornament holder is moved between said first and second position.

11. The jewelry according to claim 10, wherein said plate is configured to restrict said at least one moveable ornament holder from being moved from said first position to said second position when said jewelry is worn on a user.

* * * * *